US007798926B1

(12) United States Patent
Hsu

(10) Patent No.: US 7,798,926 B1
(45) Date of Patent: Sep. 21, 2010

(54) COMPOSITE BASEBALL BAT

(76) Inventor: Joseph Hsu, 7F-1, No. 12, Ching Shan Road, Taichung City (TW)

( * ) Notice: Subject to any disclaimer, the term of this patent is extended or adjusted under 35 U.S.C. 154(b) by 0 days.

(21) Appl. No.: 12/502,334

(22) Filed: Jul. 14, 2009

(51) Int. Cl.
*A63B 59/06* (2006.01)

(52) U.S. Cl. ..... 473/566; 473/567; 473/520

(58) Field of Classification Search ..... 473/457, 473/519, 520, 564–568
See application file for complete search history.

(56) References Cited

U.S. PATENT DOCUMENTS

| | | | | |
|---|---|---|---|---|
| 3,877,698 | A * | 4/1975 | Volpe | 473/520 |
| 4,951,948 | A * | 8/1990 | Peng | 473/520 |
| 5,219,164 | A * | 6/1993 | Peng | 473/520 |
| 5,593,158 | A * | 1/1997 | Filice et al. | 473/520 |
| 6,485,382 | B1 * | 11/2002 | Chen | 473/566 |
| 6,511,392 | B1 * | 1/2003 | Chohan | 473/564 |
| 6,808,464 | B1 * | 10/2004 | Nguyen | 473/566 |
| 6,878,080 | B2 * | 4/2005 | Chang | 473/564 |
| 6,945,886 | B2 * | 9/2005 | Eggiman et al. | 473/566 |
| 7,014,580 | B2 * | 3/2006 | Forsythe et al. | 473/566 |
| 7,044,871 | B2 * | 5/2006 | Sutherland et al. | 473/564 |
| 7,052,419 | B2 * | 5/2006 | Chang | 473/566 |
| 7,128,670 | B2 * | 10/2006 | Souders et al. | 473/567 |
| 7,201,679 | B2 * | 4/2007 | Nguyen | 473/520 |
| 7,344,461 | B2 * | 3/2008 | Van Nguyen | 473/567 |
| 7,377,866 | B2 * | 5/2008 | Van Nguyen | 473/566 |
| 7,381,141 | B2 * | 6/2008 | Van Nguyen | 473/566 |
| 2007/0155546 | A1 * | 7/2007 | Chauvin et al. | 473/520 |
| 2009/0264230 | A1 * | 10/2009 | Thouin | 473/567 |

* cited by examiner

*Primary Examiner*—Mark S Graham
(74) *Attorney, Agent, or Firm*—Muncy, Geissler, Olds & Lowe, PLLC

(57) ABSTRACT

A composite baseball bat includes a handle, which has a tapered portion formed on one end of the handle body thereof and gradually increased in diameter in direction away from the handle body, a spacer member formed of a soft material having a uniformly distributed predetermined thickness and covered on the periphery of the tapered portion of the handle, and a barrel, which is sleeved onto the handle, having a first opening ad a second opening respectively located on two distal ends thereof for the passing of the handle body of the handle and a tapered portion located on one end around the first opening and pressed on the spacer member against the tapered portion of the handle.

19 Claims, 6 Drawing Sheets

COMPOSITE BASEBALL BAT

BACKGROUND OF THE INVENTION

1. Field of the Invention

The present invention relates to a baseball bat and more particularly, to a composite baseball bat.

2. Description of the Related Art

A conventional baseball bat is a one-piece wooden or bamboo club used in the game of baseball to hit the ball after the ball is thrown by the pitcher. However, the natural material baseball bat is easy to break and is difficult to control the quality. To improve this defect, a one-piece baseball bat, which is made of combination material are created.

The one-piece combination material baseball bat is made of aluminum alloy or carbon fiber with a hollow barrel to reduce weight. The one-piece combination material baseball bat eliminates quality management and structure strength problems. But, the combination material baseball bat raises a very serious vibration defect. The vibration may hurt the arm or wrist of a batter. So, a tow-piece composite baseball bat is created.

A tow-piece conventional composite baseball bat generally comprises a handle and a barrel fastened to the handle. According to conventional techniques the gravity center may be biased after connection of the barrel to the handle. Further, the handle connects with the barrel only by glue or also by glue and thread fitting. This connection structure is permanence and makes the two-piece composite baseball bat become one. The barrel has physical contact with the handle. In other word, there is no buffer between the barrel and the handle. So vibration of the barrel still can transfer to the handle directly when the barrel hit a ball. This vibration hurts the batter also. Moreover, the bonding tightness between the handle and the barrel may be insufficient, causing rotation of the barrel relative to the handle or disconnection of the barrel from the handle upon hitting of the barrel against the ball.

Accordingly, there is a need for a composite baseball bat that eliminates the aforesaid drawbacks.

SUMMARY OF THE INVENTION

The present invention has been accomplished under the circumstances in view. It is the one object of the present invention to provide a composite baseball bat, which assures excellent connection tightness between the barrel and the handle and effectively prohibits rotation of the barrel relative to the handle or disconnection of the barrel from the handle, exhibiting excellent buffer effect.

The another object of present invention to provide a composite baseball bat, which can reduce the vibration of the handle and the handle connect with the barrel by a mechanical structure. The present invention provides an elastic material as a buffer at the connection portion of the barrel and the handle and also the present invention can provide a stable baseball bat, which has a tight structure and shock absorption effect.

To achieve this and other objects of the present invention, a composite baseball bat comprises a handle, a spacer member and a barrel. The handle has a handle body and a tapered portion formed on one end of the handle body and gradually increased in diameter in direction away from the handle body. The spacer member is formed of a soft material having a predetermined thickness. Further, the spacer member is covered on the periphery of the tapered portion of the handle. The barrel is sleeved onto the handle, having a first opening formed in a first end of the barrel body thereof, a second opening formed in a second end of the barrel body opposite to the first end and disposed in communication with the first opening, a tapered portion located on the first end of the barrel body around the first opening and pressed on the spacer member against the tapered portion of the handle.

Preferably, the composite baseball bat can be made having a knob fastened to an opposite end of the handle body remote from the tapered portion of the handle.

Further, the knob can be fastened to the opposite end of the handle body by means of a screw joint.

Further, the handle is a hollow member having an open space extending through the tapered portion thereof into the inside of the handle body.

Further, the handle has a threaded portion disposed between the handle body and tapered portion thereof. The composite baseball bat further comprises a packing device set rotatably mounted on the threaded portion of the handle and stopped against a bearing portion at one end of the barrel around the first opening.

Further, the packing device set comprises a nut threaded onto the threaded portion of the handle, and a packing ring sleeved onto the handle body and stopped between the nut and the bearing portion of the barrel.

The composite baseball bat further comprises an end cap capped on the second end of the barrel body of the barrel to seal the second opening.

Further, the handle has at least one rotation-prohibition means formed in the tapered portion thereof. The barrel further has at least one rotation-prohibition means formed in the tapered portion thereof and matching the rotation-prohibition means of the handle to prohibit rotation of the barrel relative to the handle.

Further, each rotation-prohibition means of the handle can be a plane located on the tapered portion of the handle.

Further, each rotation-prohibition means of the barrel can be a plane located on the tapered portion of the barrel.

Further, each rotation-prohibition means of the handle can be made sloping at an angle different from the sloping angle of the tapered portion of the handle.

Further, the spacer member can be a flat sheet member.

Further, the spacer member can be a tapered ring.

Further, the spacer member can be directly injection-molded on the handle over the tapered portion and rotation-prohibition means of the handle.

Further, the handle can be made having a plurality of holes cut through the tapered portion and rotation-prohibition means of the handle for the filling of the spacer member.

Further, each rotation-prohibition means of the handle can be made extending to the end of the tapered portion of the handle remote from the handle body.

Further, each rotation-prohibition means of the handle can be made sloping at an angle equal to the sloping angle of the tapered portion of the handle.

BRIEF DESCRIPTION OF THE DRAWINGS

Other and further benefits, advantages and features of the present invention will be understood by reference to the following specification in conjunction with the accompanying drawings, in which like reference characters denote like elements of structure.

DETAILED DESCRIPTION OF THE INVENTION

Figure 1:
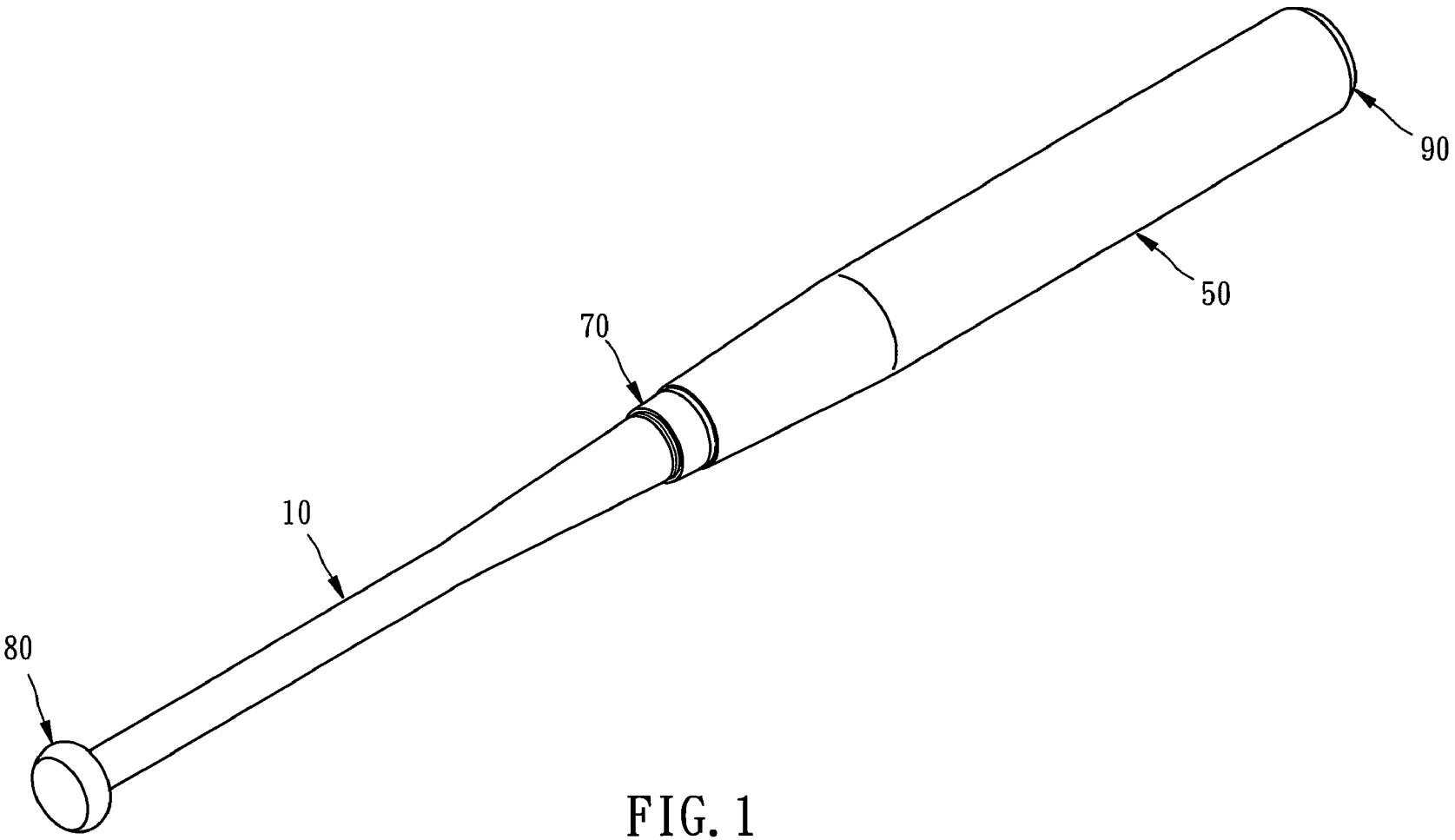
FIG. 1 is an elevational view of a composite baseball bat in accordance with the present invention.
Figure 2:
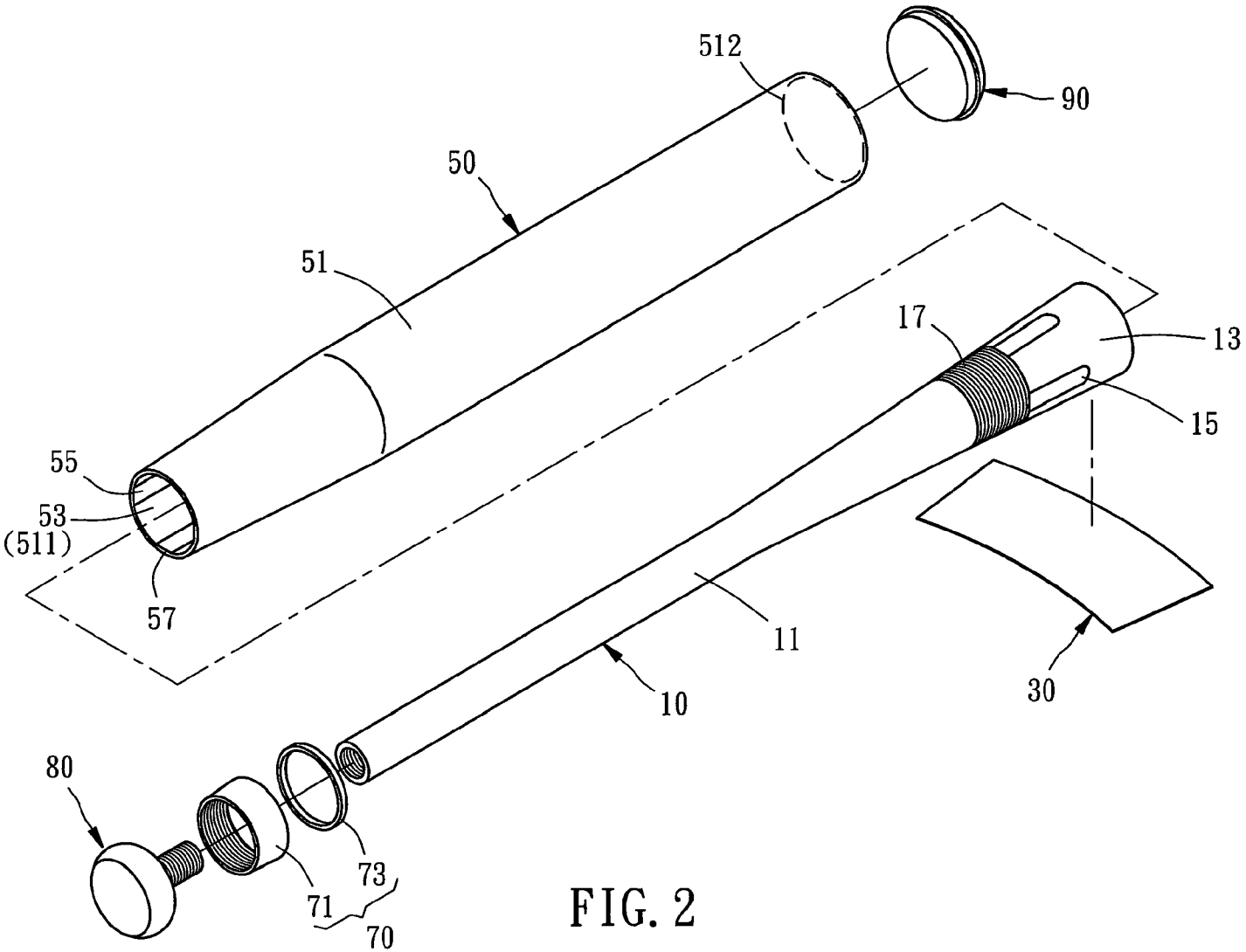
FIG. 2 is an exploded view of the composite baseball bat in accordance with the present invention.
Figure 3:
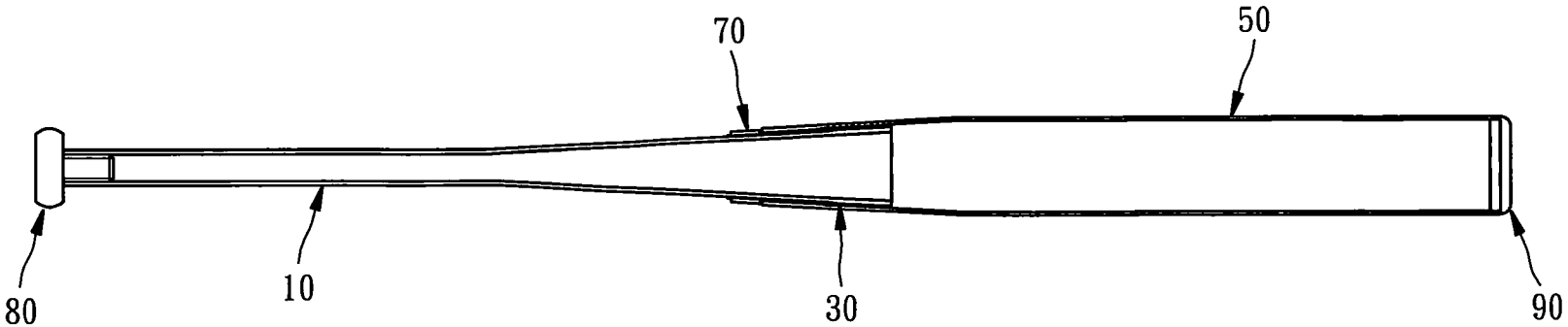
FIG. 3 is a sectional plain view of the composite baseball bat in accordance with the present invention.
Figure 5:
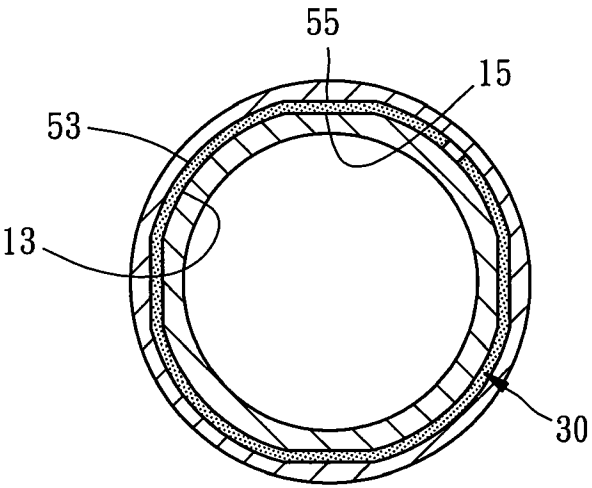
FIG. 5 is a sectional view taken, in an enlarged scale, along line 5-5 of FIG. 4.
Figure 4:
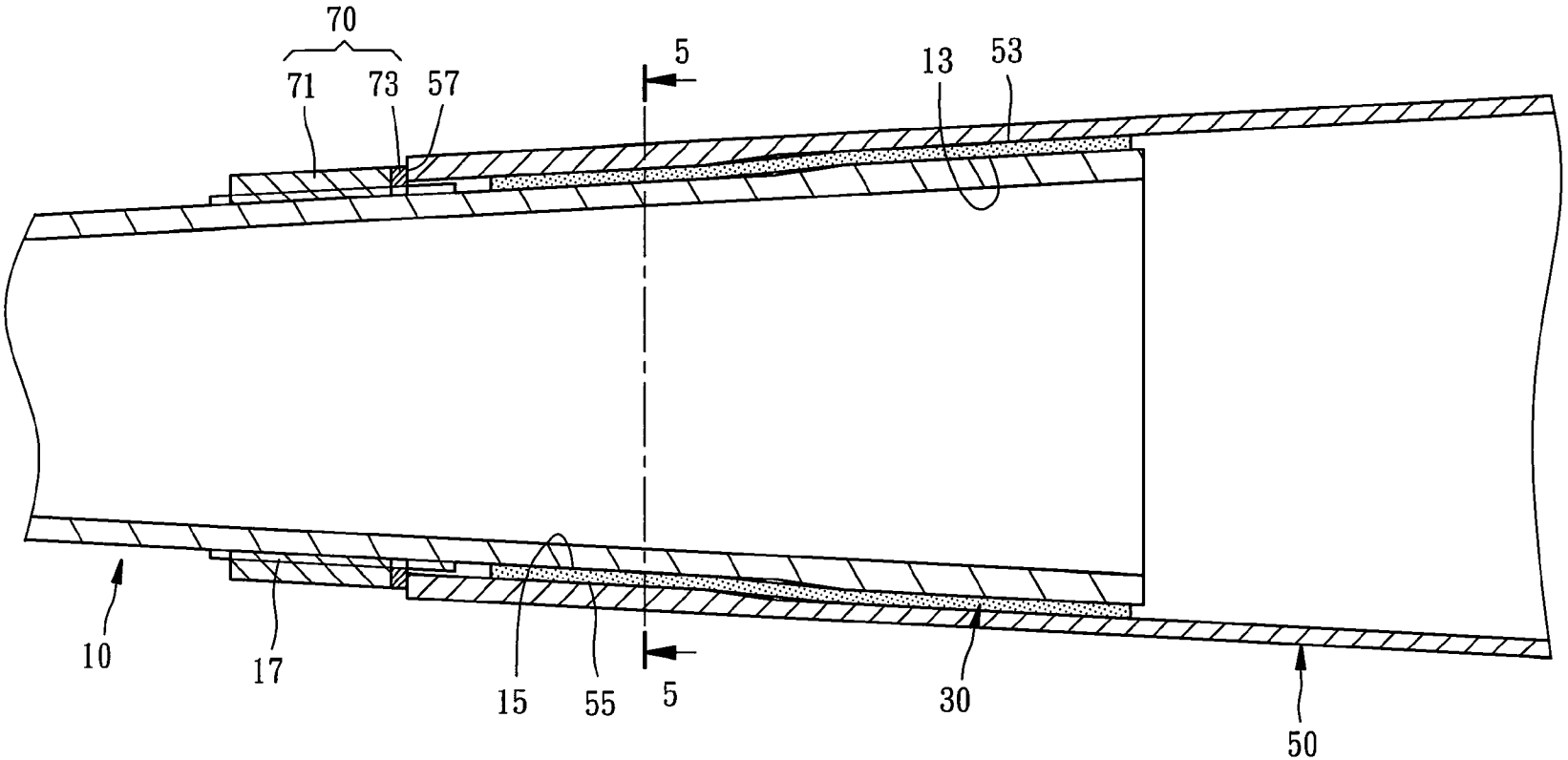
FIG. 4 is an enlarged view of a part of FIG. 3.

Referring to FIGS. 1-5, a composite baseball bat in accordance with the present invention is shown comprising a handle 10, a spacer member 30 and a barrel 50.

The handle 10 has a handle body 11, and a tapered portion 13 integrally formed on one end of the handle body 11 and gradually increased in diameter in direction away from the handle body 11. The handle 10 is a hollow member in which the open space extends through the tapered portion 13 into the inside of the handle body 11. The handle 10 further has at least one rotation-prohibition means, i.e., plane 15 located on the periphery of the tapered portion 13 for rotation prohibition. The handle 10 is made of metal like aluminum alloy or carbon fiber or a combination of aluminum alloy and carbon fiber.

The spacer member 30 is a soft material having a uniformly distributed predetermined thickness. The spacer member 30 is wrapped about the periphery of the tapered portion 13 of the handle 10. The spacer member 30 is made from rubber, silicon rubber or plastic material, which has shock absorbing function.

The barrel 50 is a hollow cylindrical member, having a barrel body 51 that defines a first opening 511 at its one end, namely, the first end, and a second opening 512 at its opposite end, namely, the second end, and a tapered portion 53 that is located on the first end of the barrel 50 around the first opening 511 and defines a tapered inner diameter that increases gradually in direction from the first opening 511 toward the second opening 512. The handle body 11 of the handle 10 is inserted through the second opening 512 of the barrel 50 and extended out of the first opening 511 of the barrel 50 to have the tapered portion 13 of the handle 10 be forced against the spacer member 30 at the tapered portion 53 of the barrel 50. The barrel 50 is made of metal like aluminum alloy or carbon fiber or a combination of aluminum alloy and carbon fiber.

In order words, the spacer member 20 is softer than the handle 10 or the barrel 50 and will be deformed by compression.

The composite baseball bat further comprises a knob 80 fastened to the other end of the handle body 11 of the handle 10 remote from the tapered portion 13 by means of, for example, a screw joint.

The handle 10 further has a threaded portion 17 disposed between the handle body 11 and the tapered portion 13. The composite baseball bat further comprises a packing device set 70 rotatably mounted on the threaded portion 17 of the handle 10 for stopping against a bearing portion 57 around the first opening 511 of the barrel 50.

The packing device set 70 comprises a nut 71 threaded onto the threaded portion 17, and a packing ring 73 sleeved onto the handle body 11 and stopped between the nut 71 and the bearing portion 57 of the barrel 50. The packing ring 73 is made from rubber, silicon rubber or plastic material, which has shock absorbing function.

The composite baseball bat further comprises an end cap 90 capped on the second end of the barrel body 51 of the barrel 50 to seal the second opening 512.

As stated above, the handle 10 has rotation-prohibition means (planes) 15 located on the periphery of the tapered portion 13 for rotation prohibition. The barrel 50 further has rotation-prohibition means 55 formed in the tapered portion 53 corresponding to the rotation-prohibition means (planes) 15 of the handle 10. According to this embodiment, each rotation-prohibition means 55 is plane matching the respective plane 15 of the handle 10.

The assembly process of the composite baseball bat is outlined hereinafter:

At first, wrap the spacer member 30 about the tapered portion 13 of the handle 10; thereafter insert the handle body 11 of the handle 10 through the barrel body 51 of the barrel 50 to force the tapered portion 13 of the handle 10 against the spacer member 30 at the tapered portion 53 of the barrel 50, thereby abutting the rotation-prohibition means (planes) 15 of the handle 10 against the rotation-prohibition means 55 of the barrel 50; and finally sleeve the packing device set 70 onto the handle body 11 of the handle 10 and thread the nut 71 onto the threaded portion 17 of the handle 10 to stop the packing ring 73 against the bearing portion 57 of the barrel 50, tightening positioning of the spacer member 30 between tapered portion 53 of the barrel 50 and the tapered portion 13 of the handle 10.

After the composite baseball bat is assembled, the spacer member 30 is tightly covered on the whole surface area of the tapered portion 13 of the handle 10, enhancing sealing and buffer effects. Further, when the nut 71 is threaded onto the threaded portion 17 of the handle 10 to stop the packing ring 73 against the bearing portion 57 of the barrel 50 tightly, the engagement between the tapered portion 13 of the handle 10 and the tapered portion 53 of the barrel 50 is enhanced, and therefore no any other tool means is necessary to tighten up the engagement between the tapered portion 13 of the handle 10 and the tapered portion 53 of the barrel 50. Further, abutting the rotation-prohibition means (planes) 15 of the handle 10 against the rotation-prohibition means 55 of the barrel 50 prohibits rotation of the barrel 50 relative to the handle 10, assuring a high level of batting safety and preventing disconnection of the barrel 50 from the handle 10.

Further, enhancements or modifications may be made to the aforesaid embodiment without departing from the spirit and scope of the present invention.

Figure 6:
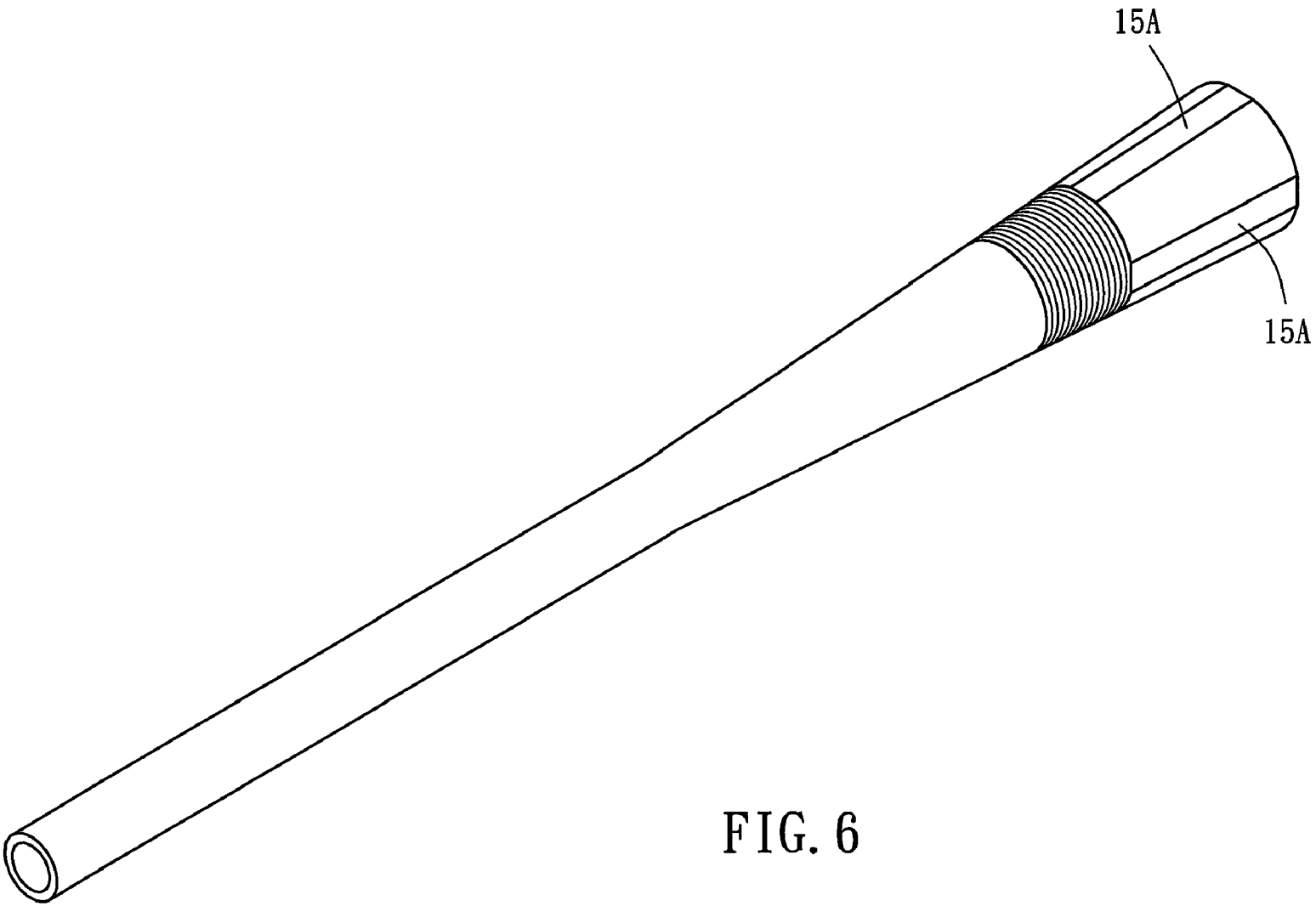
FIG. 6 is an elevational view, showing an alternate form of the handle for composite baseball bat in accordance with the present invention.

For example, as shown in FIG. 6, the rotation-prohibition means 15A of the handle 10 extends directly to the end of the tapered portion 13; the rotation-prohibition means 15; 15A may slope at an angle equal to or different from the sloping angle of the tapered portion 13.

Figure 7:
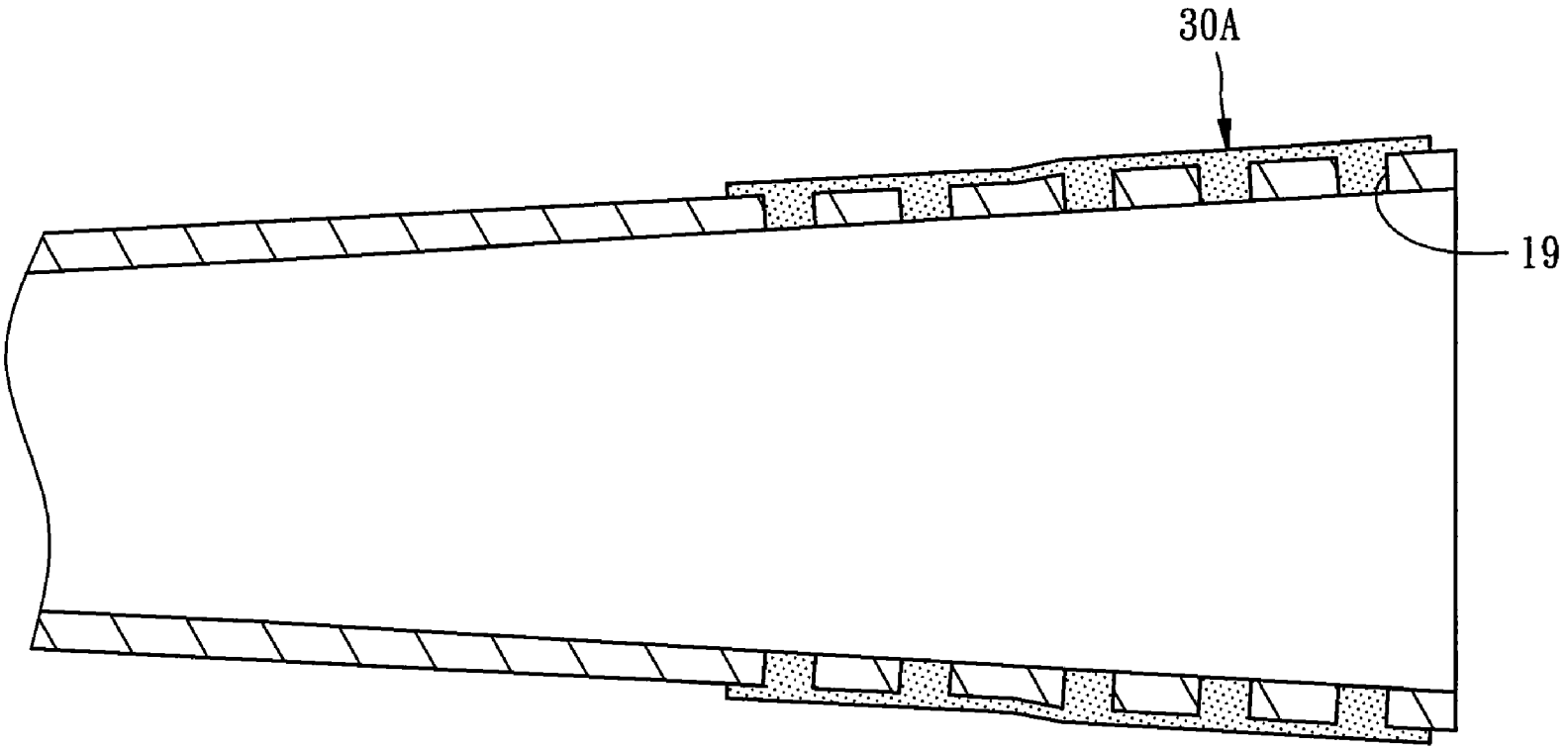
FIG. 7 illustrates a different arrangement between the spacer member and the handle according to the present invention.

Or, as shown in FIG. 7, the handle 10 can be made having holes 19 cut through the tapered portion 13 and the rotation-prohibition means (planes) 15 for the filling of the spacer member 30; the spacer member 30A can be directly injection-molded on the tapered portion 13 and the rotation-prohibition means (planes) 15 to fill up the holes 19; the spacer member 30 can be made in the form a tapered ring, facilitating installation and avoiding biasing during installation.

Further, each rotation-prohibition means of the handle can be a groove, and each rotation-prohibition means of the barrel can be a rib fitting the groove of the associating rotation-prohibition means of the handle. Alternatively, the rotation-prohibition means of the handle and the rotation-prohibition means of the barrel can be variously configured for matching to prohibit relative rotation between the handle and the barrel.

In conclusion, a composite baseball bat constructed in accordance with the present invention assures excellent connection tightness between the barrel and the handle and effectively prohibits rotation of the barrel relative to the handle or disconnection of the barrel from the handle, exhibiting excellent buffer effect.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A composite baseball bat, comprising:

a handle, said handle having a handle body and a tapered portion formed on one end of said handle body and gradually increased in diameter in direction away from said handle body;

a spacer member formed of a soft material having a predetermined thickness, said spacer member being covered on the periphery of the tapered portion of said handle;

a barrel sleeved onto said handle, said barrel having a first opening formed in a first end of a barrel body thereof, a second opening formed in a second end of said barrel body opposite to said first end and disposed in communication with said first opening, a tapered portion located on said first end of said barrel body around said first opening and pressed on said spacer member against the tapered portion of said handle;

wherein said handle has a threaded portion disposed between the handle body and tapered portion thereof; the composite baseball bat further comprises a packing device set rotatably mounted on the threaded portion of said handle and stopped against a bearing portion at one end of said barrel around said first opening.

2. The composite baseball bat as claimed in claim 1, further comprising a knob fastened to an opposite end of said handle body remote from the tapered portion of said handle.

3. The composite baseball bat as claimed in claim 2, wherein said knob is fastened to the opposite end of said handle body by means of a screw joint.

4. The composite baseball bat as claimed in claim 1, wherein said handle is a hollow member having an open space extending through said tapered portion into the inside of said handle body.

5. The composite baseball bat as claimed in claim 1, wherein said packing device set comprises a nut threaded onto the threaded portion of said handle, and a packing ring sleeved onto said handle body and stopped between said nut and said bearing portion of said barrel.

6. The composite baseball bat as claimed in claim 1, further comprising an end cap capped on the second end of said barrel body of said barrel to seal said second opening.

7. The composite baseball bat as claimed in claim 1, wherein said handle has at least one rotation-prohibition means formed in the tapered portion thereof; said barrel has at least one rotation-prohibition means formed in the tapered portion thereof and matching the rotation-prohibition means of said handle to prohibit rotation of said barrel relative to said handle.

8. The composite baseball bat as claimed in claim 7, wherein each rotation-prohibition means of said handle extends to the end of the tapered portion of said handle remote from said handle body.

9. The composite baseball bat as claimed in claim 7, wherein each rotation-prohibition means of said handle is a plane located on the tapered portion of said handle.

10. The composite baseball bat as claimed in claim 9, wherein each rotation-prohibition means of said handle slopes at an angle equal to the sloping angle of the tapered portion of said handle.

11. The composite baseball bat as claimed in claim 9, wherein each rotation-prohibition means of said handle slopes at an angle different from the sloping angle of the tapered portion of said handle.

12. The composite baseball bat as claimed in claim 9, wherein each rotation-prohibition means of said barrel is a plane located on the tapered portion of said barrel.

13. The composite baseball bat as claimed in claim 7, wherein each rotation-prohibition means of said barrel is a plane located on the tapered portion of said barrel.

14. The composite baseball bat as claimed in claim 1, wherein said spacer member is a flat sheet member.

15. The composite baseball bat as claimed in claim 1, wherein said spacer member is a tapered ring.

16. The composite baseball bat as claimed in claim 15, wherein said spacer member is directly injection-molded on said handle over the tapered portion and a rotation-prohibition means of said handle.

17. The composite baseball bat as claimed in claim 1, wherein said spacer member is directly injection-molded on said handle over the tapered portion and a rotation-prohibition means of said handle.

18. A composite baseball bat, comprising:

a handle, said handle having a handle body and a tapered portion formed on one end of said handle body and gradually increased in diameter in direction away from said handle body;

a spacer member formed of a soft material having a predetermined thickness, said spacer member being covered on the periphery of the tapered portion of said handle;

a barrel sleeved onto said handle, said barrel having a first opening formed in a first end of a barrel body thereof, a second opening formed in a second end of said barrel body opposite to said first end and disposed in communication with said first opening, a tapered portion located on said first end of said barrel body around said first opening and pressed on said spacer member against the tapered portion of said handle;

wherein said spacer member is a tapered ring;

wherein said spacer member is directly injection-molded on said handle over the tapered portion and a rotation-prohibition means of said handle; and wherein said handle has a plurality of holes cut through the tapered portion and a rotation-prohibition means of said handle for the filling of said spacer member.

19. A composite baseball bat, comprising:

a handle, said handle having a handle body and a tapered portion formed on one end of said handle body and gradually increased in diameter in direction away from said handle body;

a spacer member formed of a soft material having a predetermined thickness, said spacer member being covered on the periphery of the tapered portion of said handle;

a barrel sleeved onto said handle, said barrel having a first opening formed in a first end of a barrel body thereof, a second opening formed in a second end of said barrel body opposite to said first end and disposed in communication with said first opening, a tapered portion located on said first end of said barrel body around said first opening and pressed on said spacer member against the tapered portion of said handle;

said spacer member is directly injection-molded on said handle over the tapered portion and a rotation-prohibition means of said handle; and wherein said handle has a plurality of holes cut through the tapered portion and a rotation-prohibition means of said handle for the filling of said spacer member.

* * * * *